US005082034A

United States Patent [19]

Soper

[11] Patent Number: 5,082,034

[45] Date of Patent: Jan. 21, 1992

[54] SECONDARY CONTAINMENT DISPENSING TANK

[75] Inventor: Gerald E. Soper, Greensboro, N.C.

[73] Assignee: Four Seasons Industrial Services, Inc., Greensboro, N.C.

[21] Appl. No.: 547,989

[22] Filed: Jul. 3, 1990

[51] Int. Cl.[5] ..... B67D 5/44

[52] U.S. Cl. ..... 141/88; 141/98; 220/565; 220/571; 222/173; 137/565

[58] Field of Search ..... 141/88, 86, 98, 311 A, 141/231; 405/52, 128; 220/565, 571; 222/173, 108, 608; 137/234.6, 312, 314, 565; 184/1.5; 417/36

[56] References Cited

U.S. PATENT DOCUMENTS

| | | | |
|---|---|---|---|
| 1,713,657 | 5/1929 | Hogan | 137/565 |
| 2,256,673 | 9/1941 | Hansen | 220/565 X |
| 2,543,669 | 2/1951 | Price | 137/565 |
| 2,552,749 | 5/1951 | Tabet | 184/1.5 |
| 2,790,629 | 4/1957 | McGovern et al. | 137/565 X |
| 4,422,485 | 12/1983 | O'Shea et al. | 141/98 |
| 4,765,775 | 8/1988 | Kroger | 405/52 |
| 4,875,595 | 10/1989 | Valkenburg | 220/1.5 |
| 4,890,653 | 1/1990 | Sartulairi | 141/231 X |
| 4,905,871 | 3/1990 | Dutertre | 222/108 X |
| 4,934,553 | 6/1990 | McCarthy | 220/565 X |
| 4,948,340 | 8/1990 | Solomon et al. | 137/565 X |
| 4,960,222 | 10/1990 | Fields, III | 220/571 X |
| 4,988,020 | 1/1991 | Webb | 141/88 X |
| 5,016,689 | 5/1991 | McGarvey et al. | 141/88 X |

FOREIGN PATENT DOCUMENTS

| | | | |
|---|---|---|---|
| 2209183 | 4/1989 | United Kingdom | 220/571 |

OTHER PUBLICATIONS

Product Brochure entitled Dike-Tanks, The Bendel Co., undated.

*Primary Examiner*—Henry J. Recla
*Assistant Examiner*—Casey Jacyna
*Attorney, Agent, or Firm*—Rhodes, Coats & Bennett

[57] ABSTRACT

An above-ground secondary containment dispensing system for a primary tank holding liquids. The system includes a 10,000 gallon primary tank and a secondary containment unit which includes a dike surrounding the tank. In the preferred embodiment, the dike is a right parallepiped having an open top and a floor. Preferably, the dike is provided with internal support means to support the tank above the floor of the dike and an external support means to support the dike above the ground to enable the entire unit to be moved easily. A loading platform is mounted adjacent to the tank and includes both glycol and water loading arms. In the preferred embodiment, a single pump is used for both tank off-loading and to issue product to the de-icing units. Preferably, a level detector mounted in the tank is operatively associated with the pump to disable the pump when the tank is full and/or to provide an indication to a user when the tank is full. Preferably, the usable volume of the dike is at least 100 percent of the usable volume of the primary tank.

14 Claims, 3 Drawing Sheets

SECONDARY CONTAINMENT DISPENSING TANK

BACKGROUND OF THE INVENTION (1) Field of the Invention

The present invention relates generally to liquid dispensing systems and, more particularly, to an above-ground secondary containment dispensing tank for dispensing hazardous fluids, such as mixtures of de-icing fluid and water, or any other liquids which might cause an environmental problem if released into the ground.

(2) Description of the Prior Art

Recently-adopted regulations of the Environmental Protection Agency require that above-ground tanks be provided with a secondary containment device to catch and retain any spills or leaks from the primary above ground tank. Known products for this purpose have taken the form of a large open-topped tub, usually called a dike, into which the primary tank is placed.

For example, the product brochure for BENDEL Dike-Tanks discloses a dike which is built onto an above-ground storage tank which can be shipped as an integral unit. This arrangement permits leaks and overfills to be caught and prevented from contaminating the ground.

U.S. Pat. No. 4,875,595, issued to Van Valkenburg, discloses a storage enclosure for storing containers of hazardous material having a secondary containment feature. The storage enclosure includes a one-piece containment pan cradled within a support frame which allows the visual inspection of the underside of the containment pan.

However, such containment systems usually do not provide any protection for the means for filling the tank and dispensing the liquid from the tank. Consequently, a leak in the fluid handling system can result in contamination of the soil surrounding the containment system.

Thus, there remains a need for a new and improved a above-ground secondary containment tank for dispensing hazardous fluids which overcomes the problems of conventional spills while, at the same time, preventing contamination due to leaks in the fluid handling system.

SUMMARY OF THE INVENTION

The present invention solves these problems by providing an above-ground secondary containment dispensing system for a primary tank holding liquids. The system includes a 10,000 gallon primary tank and a secondary containment unit which includes a dike surrounding the tank. In the preferred embodiment, the dike is a right parallepiped having an open top and a floor. The dike is mounted on 8-inch I-beams to enable the entire unit to be moved easily. Preferably, the dike also is provided with internal support means to support the tank above the floor of the dike. A loading platform is mounted adjacent to the tank and includes both glycol and water loading arms. In the preferred embodiment, a single pump is used for both tank off-loading and to issue product to the de-icing units.

The containment system may be marketed with an installed tank or without an installed tank, with the user installing the tank himself.

Preferably, a closable access way in the primary tank is provided to permit the inspection of the tank and of the interior of the dike to check for leakage from the tank.

Preferably, a level detector mounted in the tank is operatively associated with the pump to disable the pump when the tank is full and/or to provide an indication to a user when the tank is full.

Preferably, the volume of the dike is at least 100 percent of the volume of the primary tank.

Accordingly, one aspect of the present invention is to provide an above-ground secondary containment and dispensing system for a primary tank holding a fluid. The system includes a dike surrounding the primary tank; a loading platform adjacent to the dike adapted for permitting an operator to dispense the fluid from the primary tank to a fluid receiving vehicle; and a fluid handling system located in a portion of the dike adjacent to the primary tank for off-loading the fluid into the primary tank and dispensing the fluid stored in the primary tank, wherein spills from either the primary tank or the fluid handling system are contained within the dike.

Another aspect of the present invention is to provide a fluid handling system for an above-ground dispensing system for a primary tank holding a fluid. The fluid handling system includes a fluid inlet; pump means connected to the fluid inlet; a first fluid outlet connected to the primary tank for permitting the primary tank to be filled; a second fluid outlet connected to the dispensing system for permitting fluid to be dispensed; and means operable to select between the first and second fluid outlets, whereby the pump means is operable to selectively fill the primary tank and dispense the fluid.

Still another aspect of the present invention is to provide an above-ground secondary containment and dispensing system for a primary tank holding a fluid. The system includes a dike surrounding the primary tank; a loading platform adjacent to the dike adapted for permitting an operator to dispense the fluid from the primary tank to a fluid receiving vehicle; and a fluid handling system located in a portion of the dike adjacent to the primary tank and having pump means for off-loading the fluid into the primary tank and dispensing the fluid stored in the primary tank, wherein spills from either the primary tank or the fluid handling system are contained within the dike.

These and other aspects of the present invention will become apparent to those skilled in the art after a reading of the following description of the preferred embodiment when considered with the drawings.

DETAILED DESCRIPTION OF PREFERRED EMBODIMENTS

In the following description, like references characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 1:
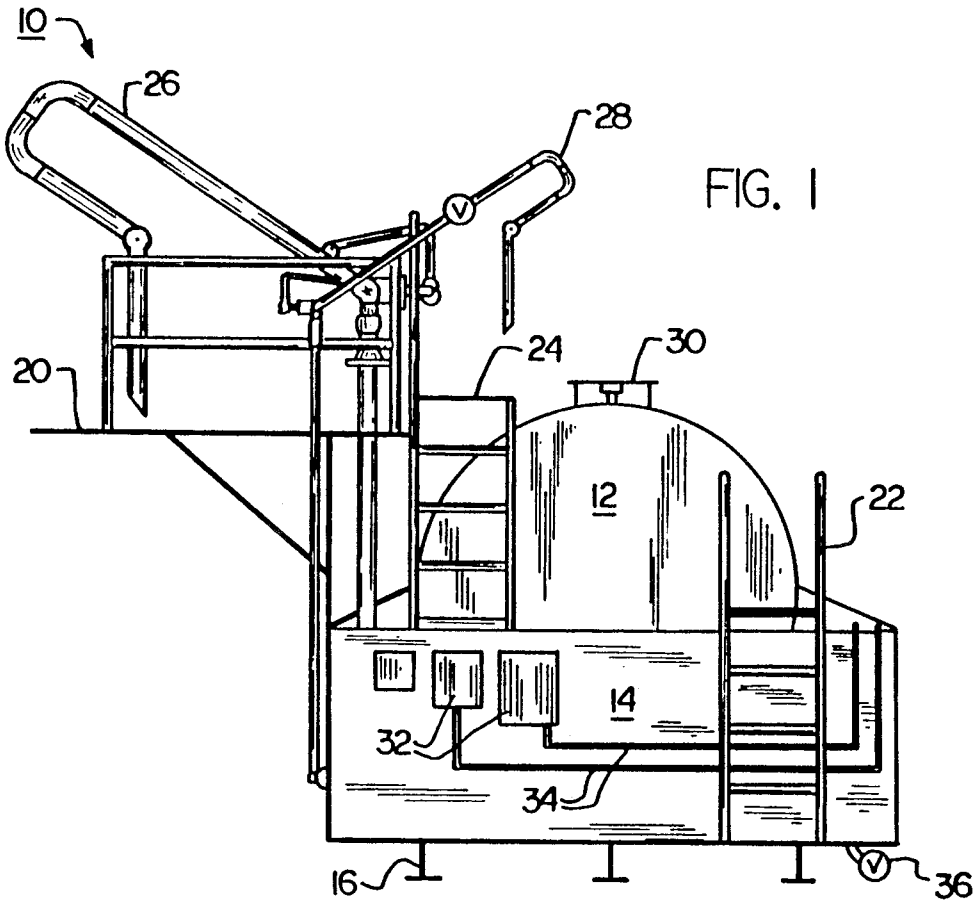
FIG. 1 is an end elevational view of an above-ground secondary containment dispensing tank constructed according to the present invention.

Referring now to the drawings in general and FIG. 1 in particular, it will be understood that the illustrations are for the purpose of describing a preferred embodiment of the invention and are not intended to limit the invention thereto. As best seen in FIG. 1, a secondary containment dispensing tank, generally designated 10, is shown constructed according to the present invention.

The primary tank 12 is surrounded by a parallepiped shaped dike 14. Dike 14 rests on a plurality of 8 inch I-beams 16. A loading platform, generally designated 20, is attached to one side of dike 14. Ladder 22 permits entry into and exit from dike 14. Ladder 24 permits entry onto and exit from one end of platform 20. Platform 20 also includes a glycol loading arm 26 for dispensing the glycol solution and preferably includes a water loading arm 28 for dispensing the water solution. Primary tank 12 includes a manway 30 for inspection of the tank 12 and installation of components within the tank 12. Electrical controls 32 are located on one end of dike 14. A conduit 34 connects the controls 32 to the pumping system (not shown). A 2-inch drain line 36 located at the one end of dike 14 permits the dike to be drained and cleaned.

The present invention provides a secondary containment enclosure for above-ground tanks for holding hazardous or toxic liquids such as glycol de-icing fluid, solvents or other petroleum products, other mixtures and solutions. The invention may be used on the one hand in connection with liquids which are stored as usable material, fuels, feedstocks or other raw materials, or on the other hand in connection with storage of waste materials if needed. The device can be made in a wide range of sizes, to accommodate primary tanks of 275 gallons up to 20,000 gallons or larger, as desired.

Figure 2:
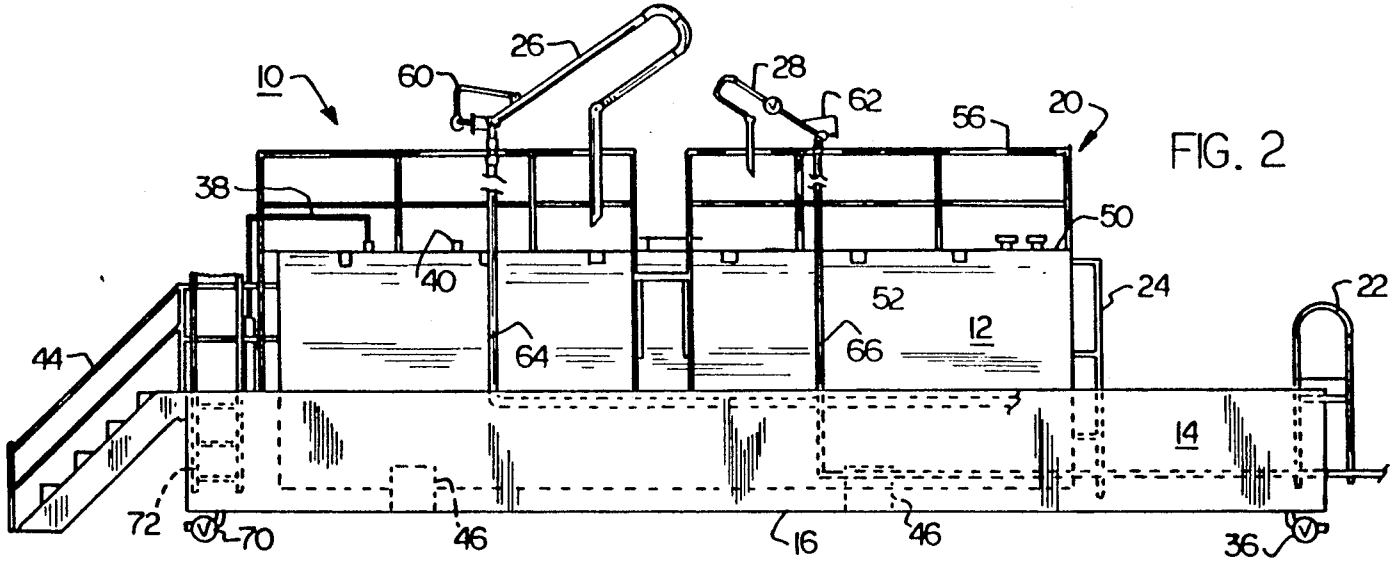
FIG. 2 is a side elevational view thereof.

As best seen in FIG. 2, the basic hardware of the apparatus which is used as a secondary containment dike for a cylindrical primary tank 12, shown in phantom in all three figures, is illustrated. Dike 14 is arranged as a right parallepiped, including a floor and upstanding side walls on four sides, with an open top. An external support 16 is provided so that the apparatus can be manipulated by a fork truck or the like.

The primary tank 12 includes a liquid level gauge 38 attached to one end of the tank 12. A vent 40 is located on the upper surface of the tank 12. A liquid level control 42 is located on the other end of the tank 12. Steps 44 for permit entry onto and exit from the other end of platform 20. An emergency vent opening 40 is also provided in the primary tank 12. Saddle supports 46 located in the bottom of the dike 14, shown dotted, support the lower portion of the tank 12 and keep the shell of tank 12 out of contact with the dike 14.

The dike 14 serves to provide a secondary containment system for the primary tank 10. Thus, a leak in primary tank 10 will be contained in the dike 12 and not be passed to the underlying ground and causing contamination. In addition, since the entire fluid handling system is housed within the dike 14, any overfill of liquid being filled into the tank 12 will be caught by the dike 14 in a similar fashion. In addition, supports 46 provide further protection for the primary tank 12 to prevent corrosion or other damage.

A loading platform 20 includes a catwalk 50 which is attached between the dike 14 and the upper portion of the tank 12 by support brackets 52. A tanker loading platform 54 extends outwardly from catwalk 50. Handrails 56 around the edge of the catwalk 50 provide some measure of safety. The loading arms 26,28 include swivel actuation joints 60,62 for permitting the flow of the liquid to be directed and controlled. Swivels 60,62 are connected respectively to issue lines 64,66. A second 2-inch drain line 70 may be added to the opposite end of the dike 14. In addition, an extra ladder 72 may be added to permit entry into and exit from dike 14.

Figure 3:
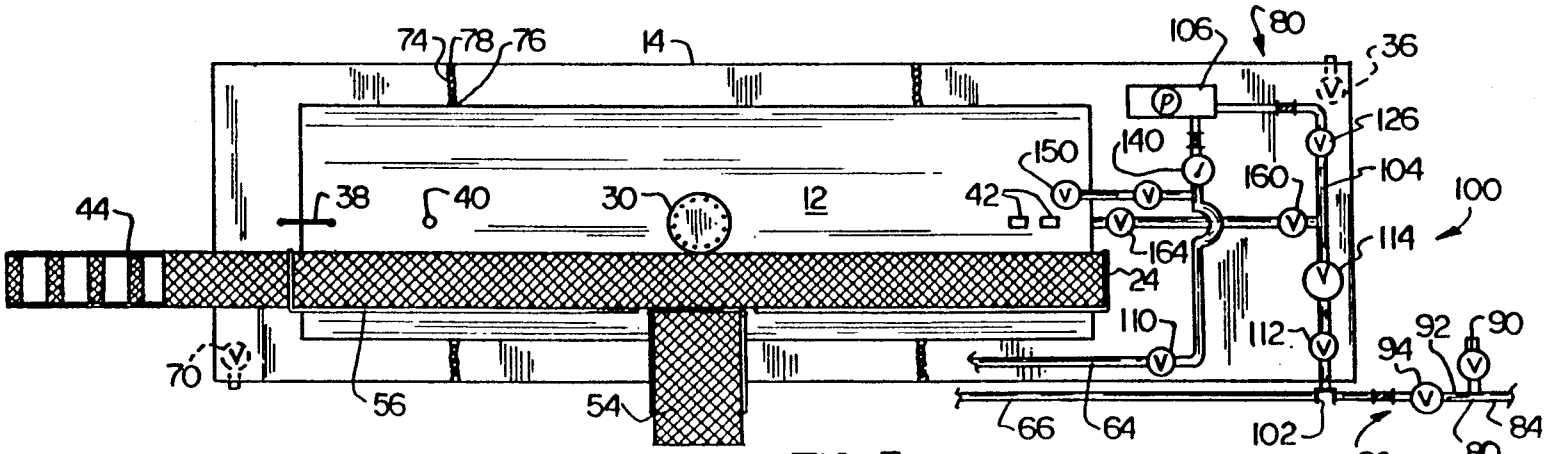
FIG. 3 is a top plan view thereof.

As best seen in FIG. 3, a plurality of chains 74 are attached between tank brackets 76 and dike brackets 78 secure the primary tank 12 within dike 14.

The fluid handling system, generally designated 80, includes a water handling subsystem 82. Water handling subsystem 82 includes a connection to the main water supply 84 which brings the water to a Tee-connection 86. Tee-connection 86 includes a drain valve 90 and an outlet 92. A ball valve 94 is attached to outlet 92. A small section of flex pipe 96 connects the ball valve 94 to issue line 66 to isolate the water handling system from any vibration from the main water line.

The glycol handling system is generally designated 100. It includes a loading header 102 which is connected to piping, generally designated 104, and a pump assembly 106. A ball valve 110 permits the flow to issue line 64 to be selectively cut on and off.

Figure 4:
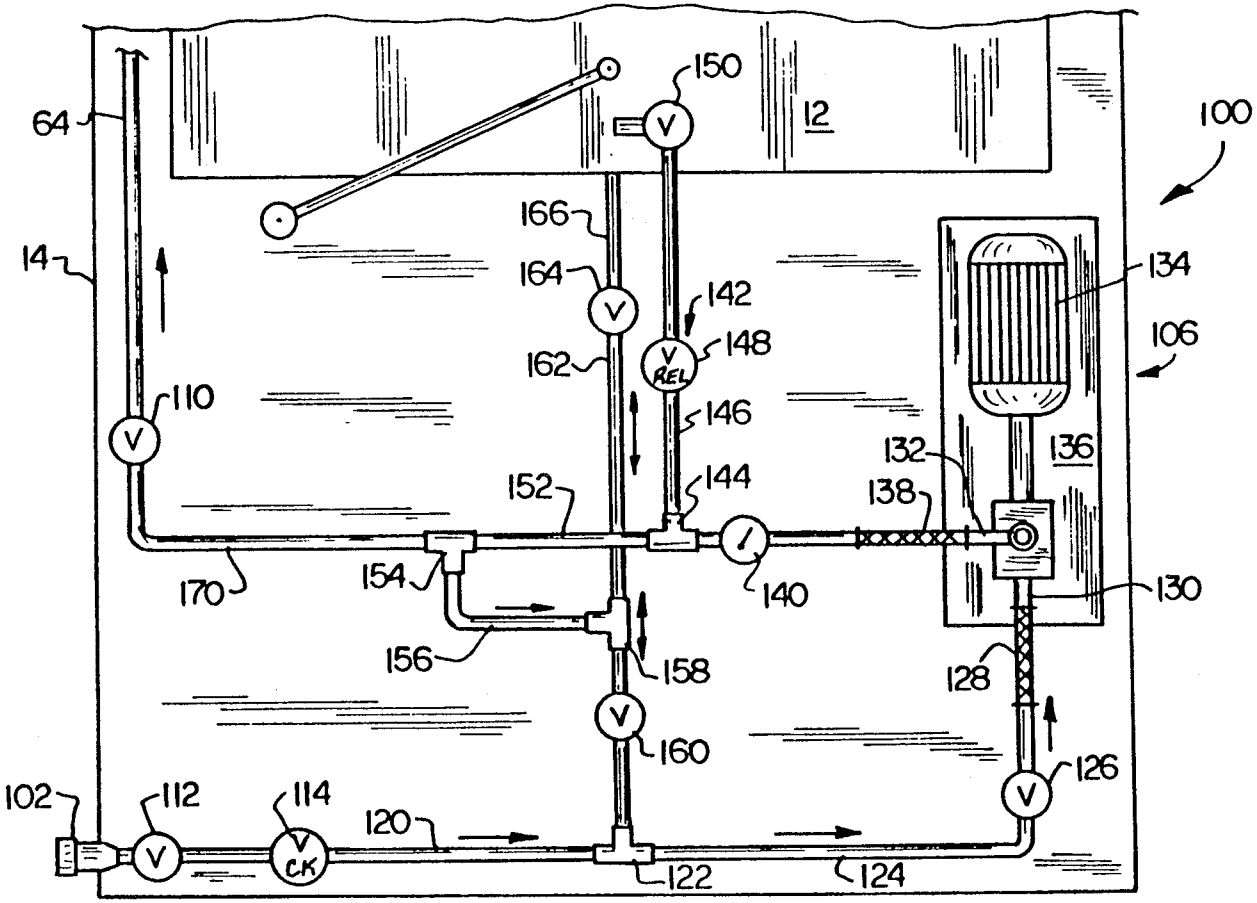
FIG. 4 is a enlarged top plan view of the fluid handling system shown in FIG. 3.

As best seen in FIG. 4, the fluid handling system 80 for the above-ground secondary containment dispensing system 10 includes a fluid inlet 102 located in one wall of the secondary containment dike 14. Pump assembly 106 is connected to inlet 102. A ball valve 112 permits the fluid handling system 80 to be isolated from the inlet 102. A check valve 114 is located between the pump assembly 106 and the inlet 102 for preventing the loss of fluid from said fluid handling system.

A fluid outlet 166 connected to the primary tank 12 permits the primary tank 12 to be filled. Issue line 64 connected to the dispensing system permits the fluid to be dispensed.

A first tee 122 is located between the fluid inlet 102 and the inlet 130 of the pump assembly 106. A ball valve 126 located in pump inlet line 124 permits pump assembly 106 to be isolated from the fluid handling system 80. Stainless steel flex pipes 128,138 prevent the vibration of pump assembly 106 from being conducted to the remainder of fluid handling system. 80. A second tee 154 is located between the outlet 132 of the pump assembly 106 and issue line 64. A third tee 158 is located between the first tee 122 and the second tee 154.

A first valve 160 is located between the first tee 122 and the third tee 158. Ball valve 110 is between the second tee 154 and issue line 64. Each of valves 110,160 is movable between a first open position and a second closed position, wherein when valves 110,160 are closed the pump assembly fills primary tank 12 and when valves 110,160 are open the pump assembly dispenses the fluid.

Pump motor 134 rests on mounting 136 and is powered by an electrical power supply connected through electrical controls 32 to level detectors/switch and alarm 42. Thus, when the tank is filled, the level detector/switch 42 will open the circuit to the pump motor 134, disabling further dispensing into the tank 12 and preventing an overfill, and actuating alarm to indicate the full condition, so that measures to discontinue filling the tank 12 ca be taken.

Certain modifications and improvements will occur to those skilled in the art upon reading of the foregoing description. By way of example, the exact arrangement of the fluid handling system can be varied depending on the spacing available in the dike. It should be understood that all such modifications and improvements have been deleted herein for the sake of conciseness and readability but are properly within the scope of the following claims.

I claim:

1. An above-ground secondary containment and dispensing system for a primary tank holding a fluid comprising:

a) a dike surrounding said primary tank;

b) a loading platform adjacent to said dike adapted for permitting an operator to dispense said fluid from said primary tank to a fluid receiving vehicle; and c) a fluid handling system located in a portion of said dike adjacent to said primary tank and having pump means for off-loading said fluid into said primary tank and dispensing said fluid stored in said primary tank, wherein spills from either said primary tank or said fluid handling system are contained with said dike, wherein said fluid handling system located in a portion of said dike adjacent to said primary tank and having pump means for off-loading said fluid into said primary tank and dispensing said fluid stored in said primary tank includes: i) a fluid inlet located in one wall of said secondary containment dike and connected to said pump means; ii) a first fluid outlet connected to said primary tank for permitting said primary tank to be filled; iii) a second fluid outlet connected to said dispensing system for permitting fluid to be dispensed; and iv) means operable to selected between said first and second fluid outlets, whereby said pump means is operable to selectively fill said primary tank and dispense said fluid, wherein said means operable to select between said first and second fluid outlet includes a first tee between said fluid inlet and the inlet of said pump means, a second tee between the outlet of said pump means and said fluid outlet, and a third tee between said first tee and said second tee and wherein said means operable to selected between said first and second fluid outlet further includes a first valve between said first tee and said third tee and a second valve between said second tee and said fluid output, each of said first and second valves being movable between a first open position and a second closed position, wherein when said first and second valves are closed said pump means fills said primary tank and when said first and second valves are open said pump means dispenses said fluid.

2. A system according to claim 1, wherein said dike substantially encloses the bottom and sides of said primary tank.

3. A system according to claim 2, wherein said dike is a right parallepiped having an open top and a floor.

4. A system according to claim 1, wherein the volume of the dike is at least 100% of the volume of said primary tank.

5. A system according to claim 1, wherein said loading platform includes a flat top surface and a guard rail along the edge of said flat top surface opposite said primary tank for permitting the operator to walk thereon.

6. A system according to claim 5, wherein a portion said flat top surface which extend outwardly from said main portion of said flat top surface away from said primary tank for permitting the operator to step out over the fluid receiving vehicle.

7. A system according to claim 1 in combination with said primary tank.

8. A system according to claim 7, wherein said dike and said primary tank are secured together by a removable securing means.

9. A system according to claim 1, wherein said dike is provided with internal support means to support said primary tank above said floor.

10. A system according to claim 9, wherein said dike is provided with external support means to support the dike above the ground.

11. A system according to claim 1, further including a level detector mounted in said primary tank which disables said pump when said primary tank is full.

12. A system according to claim 1, further including a level detector mounted in said primary tank which provides an indication to a user when said primary tank is full.

13. A system according to claim 1, wherein said means operable to selected between said first and second fluid outlet further includes a check valve between said pump means and said fluid inlet for preventing the loss of fluid from said fluid handling system.

14. A system according to claim 1, wherein said means operable to selected between said first and second fluid outlet further includes a check valve between said pump means and said first tee for preventing the loss of fluid from said fluid handling system.

* * * * *